United States Patent [19]

Quiogue

[11] Patent Number: 4,488,205

[45] Date of Patent: Dec. 11, 1984

[54] FLOODLIGHT LUMINAIRE WITH ROTATABLE REFLECTOR

[75] Inventor: Honesto D. Quiogue, Blacksburg, Va.

[73] Assignee: Harvey Hubbell Incorporated, Orange, Conn.

[21] Appl. No.: 552,609

[22] Filed: Nov. 17, 1983

[51] Int. Cl.[3] ..... F21S 3/00

[52] U.S. Cl. ..... 362/223; 362/217; 362/277; 362/280; 362/296; 362/307; 362/362; 362/374; 362/375; 362/449

[58] Field of Search ..... 362/277, 280, 217, 223, 362/296, 307, 362, 374, 375, 449

[56] References Cited

U.S. PATENT DOCUMENTS

| | | | |
|---|---|---|---|
| 996,154 | 6/1911 | Spencer | 362/227 |
| 1,291,945 | 1/1919 | Libson | 362/257 |
| 1,881,329 | 10/1932 | Seaberg | 362/301 X |
| 2,327,552 | 8/1943 | Poehling | 362/227 |
| 3,610,915 | 1/1971 | Moore | 362/347 X |
| 4,155,111 | 5/1979 | Kelly et al. | 362/374 |
| 4,156,902 | 5/1979 | Wandler | 362/307 |
| 4,237,528 | 12/1980 | Baldwin | 362/347 X |
| 4,261,030 | 4/1981 | Hernández | 362/296 |
| 4,300,187 | 11/1981 | Fletcher | 362/280 X |
| 4,379,322 | 5/1983 | Kelly | 362/300 |
| 4,422,133 | 12/1983 | Elmer | 362/277 |

*Primary Examiner*—Stephen J. Lechert, Jr.

*Attorney, Agent, or Firm*—Jerry M. Presson; Walter C. Farley

[57] ABSTRACT

A luminaire includes a generally parallelepipedic housing with a square opening into which a reflector and lamp assembly can be inserted and fastened. The opening is square as is the reflector so that it can be extracted and rotated 90° as a unit. The reflector has a parabolic concave reflective surface and a lamp with an elongated light source, producing a rectangular pattern which is rotated as the orientation of the reflector is rotated.

11 Claims, 6 Drawing Figures

10
15
16
28
29
30
31
32
36

FLOODLIGHT LUMINAIRE WITH ROTATABLE REFLECTORSPECIFICATION

This invention relates to a luminaire and particularly to a floodlight luminaire having an improved reflector, lamp mounting and housing arrangement.

BACKGROUND OF THE INVENTION

Luminaires which are to be used for outdoor lighting are quite frequently used in situations which require a light distribution pattern of a specific shape and which also have rather severe restrictions on the mounting supports available at reasonable cost. These requirements and limitations are not only inconsistent in some circumstances but are often not predictable until the luminaire is taken to the point of installation and use. For most luminaires, the lighting pattern is a relatively unchangeable function of the available mounting or, alternatively, special arrangements must be made at extra cost.

For example, if an outdoor sign is to be illuminated by a number of units mounted on the sign support, the desired pattern of light depends upon the relationship of the sign shape and the support position. If the sign aspect is relatively tall and narrow, a vertically spread pattern is needed. Alternatively, if the width is greater, a horizontal pattern is desired, but the available support for the luminaire may be the same in both cases. Obviously, if one form of luminaire is available, then one of the signs will not be properly lighted.

Similar problems arise when mounting a plurality of units to illuminate an area such as a building exterior, playing field or parking region. While special purpose luminaires for each of these uses exist, it is not desirable to have to maintain an inventory of a large number of different kinds of units.

BRIEF SUMMARY OF THE INVENTION

Accordingly, an object of the present invention is to provide a relatively simple luminaire having a housing which is easily mounted in a variety of orientations and under differing circumstances, and which has a lamp and reflector structure designed to be easily rotated through an angle of 90° relative to the housing.

A further object is to provide such a luminaire in which the reflector and lamp structure is formed as a relatively independent assembly and produces a specific generally rectangular pattern of light.

Briefly described, the invention includes a housing having a generally parallelepipedic shape and a square open side, and having a mounting device fixedly attached to an exterior surface of the housing. The open side can be provided with a hinged transparent cover. Within the housing is a reflector and lamp structure including a reflector having a curved, concave reflective surface and a square periphery dimensioned to be received in the open side of the housing in any one of its four orientations, and a lamp socket mount fixedly attached to the reflector and extending rearwardly thereof. A lamp socket is attached to the mount and extends through the reflector to hold a lamp in front of the concave surface, the lamp being of the type which has an elongated light source therein. Finally, the basic structure includes conventional fasteners for removably attaching the reflector, mount, lamp and socket to the housing in any selected one of the orientations.

As will be further described, with a lamp having an elongated arc light source therein, and with a parabolic reflector, the assembly produces a relatively narrow, substantially parallel beam in one plane and a wide beam in a plane perpendicular thereto.

In order that the manner in which the foregoing and other objects are attained in accordance with the invention can be understood in detail, a particularly advantageous embodiment thereof will be described with reference to the accompanying drawings, which form a part of the specification, and wherein.

Figures 2, 3, 4, 5:
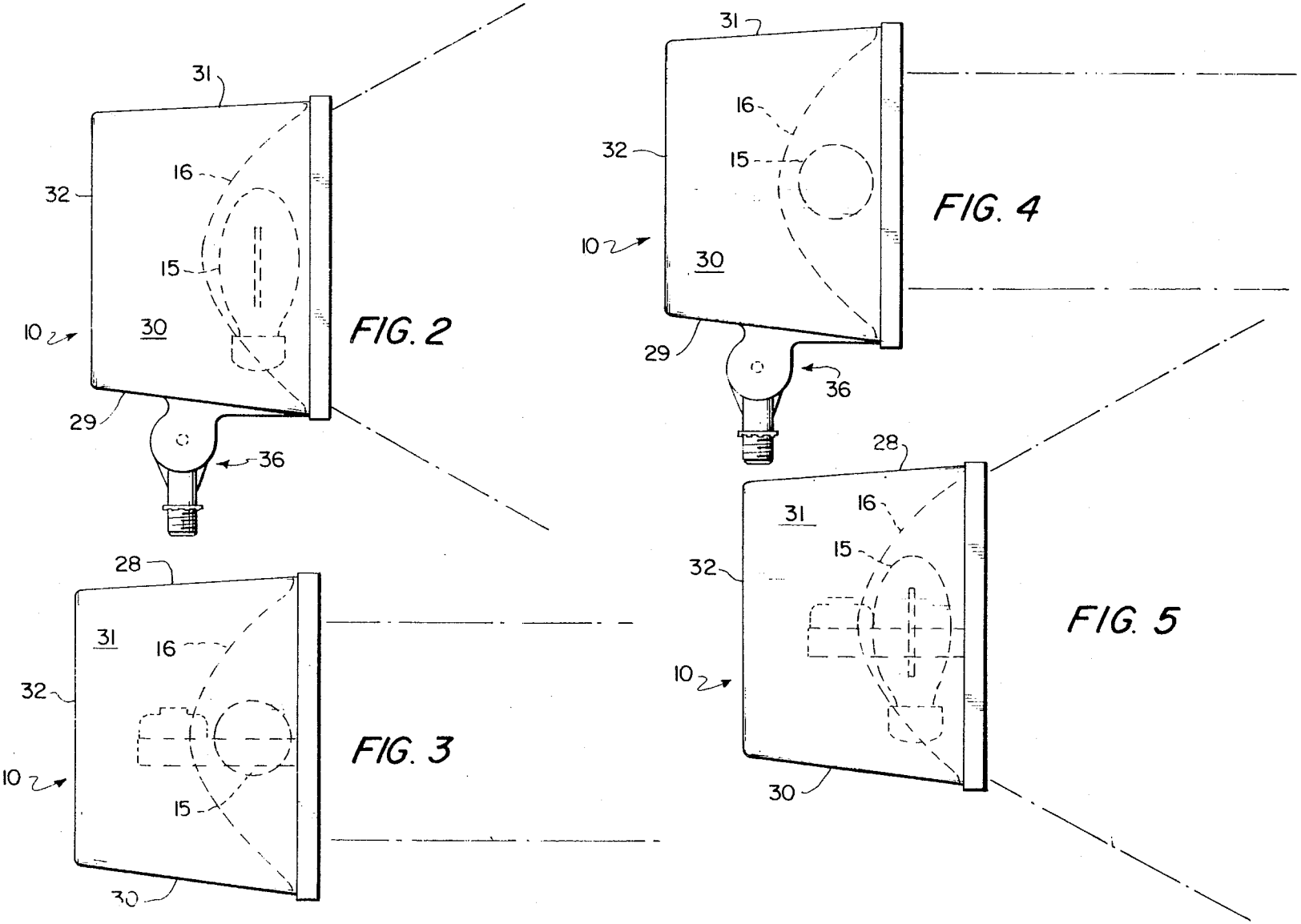
FIG. 2 is a side elevation of the luminaire of FIG. 1 showing the light pattern produced thereby with the reflector and lamp assembly mounted in one orientation.
FIG. 3 is a top plan view of the luminaire of FIGS. 1 and 2 showing the light pattern produced with the orientation of FIG. 2.
Figure 6:
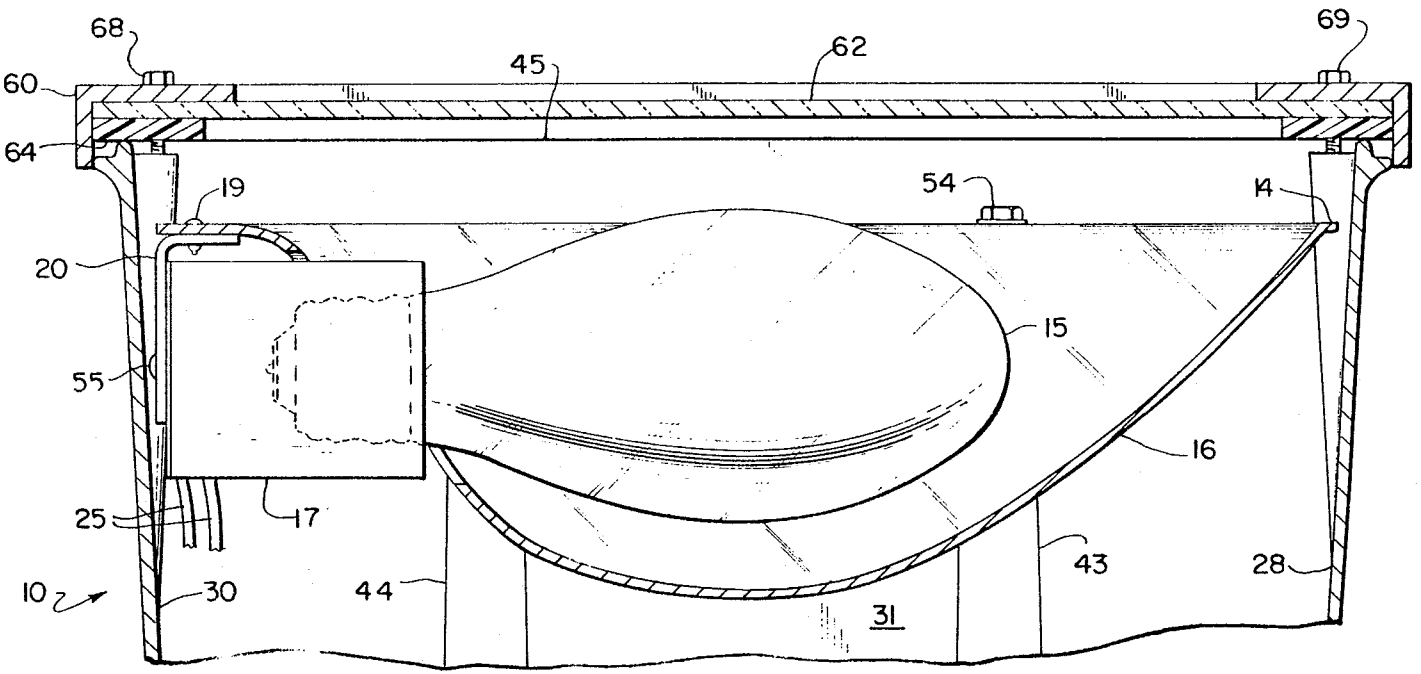

FIGS. 4 and 5 are a side elevation and a top plan view, respectively, showing the light pattern produced with the lamp and reflector in an orientation 90° from that of FIGS. 2 and 3; and FIG. 6 is a partial side elevation, in partial section, of the forward portion of the housing, with the cover, with the lamp and reflector assembly mounted therein in one of its orientations.

DETAILED DESCRIPTION OF THE DRAWINGS

Figure 1:
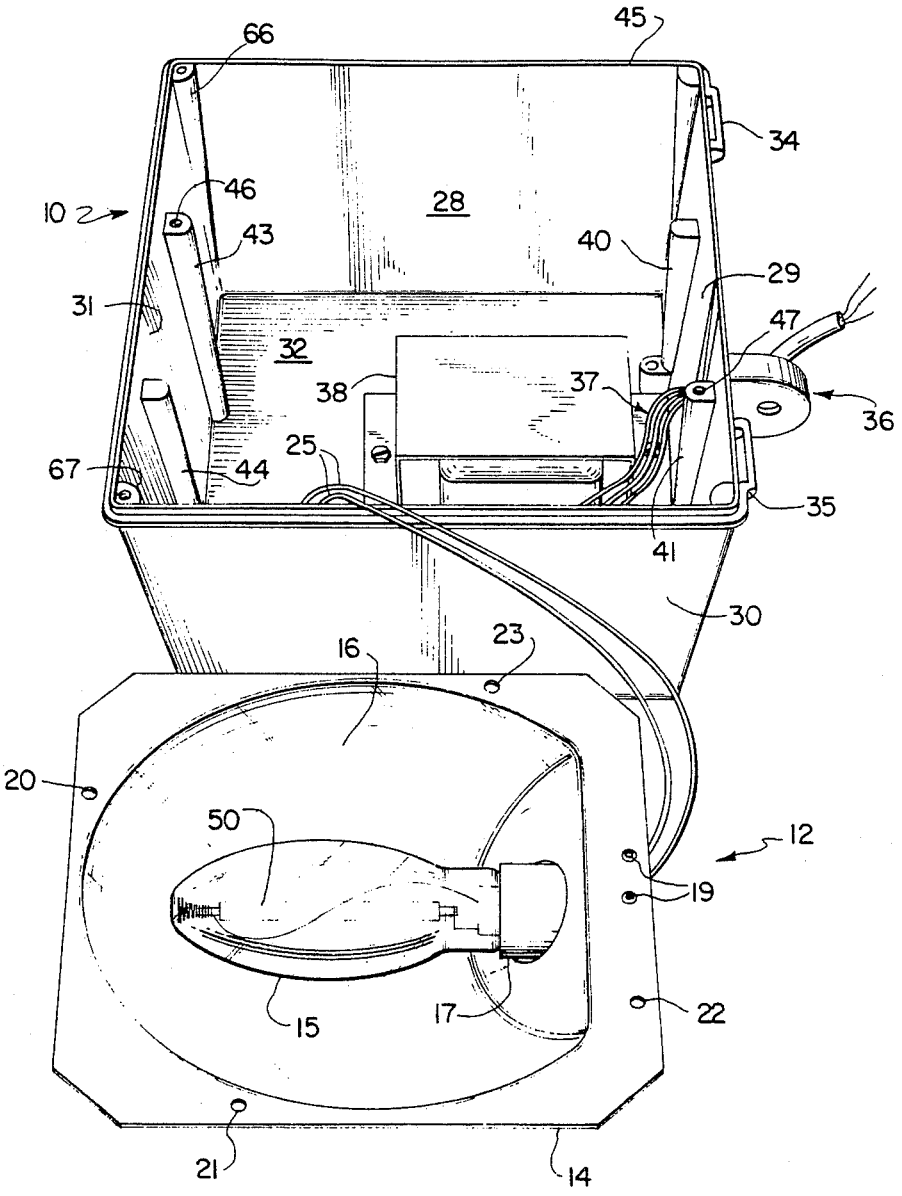
FIG. 1 is a perspective view of a luminaire in accordance with the present invention with the reflector and lamp assembly partially removed from the housing.

Referring first to FIG. 1, it will be seen that the luminaire includes a housing indicated generally at 10 and a reflector assembly indicated generally at 12. Assembly 12 includes the reflector 14 itself along with a lamp 15, a lamp socket 17 and a mounting bracket for the lamp socket not visible in FIG. 1, the bracket being attached to the reflector by rivets 19. Reflector 14 has a symmetrical concave reflective portion 16 which, in the embodiment shown, is parabolic. Of particular importance in the reflector is the provision of four holes 20, 21, 22 and 23 which are positioned so as to be usable in pairs, holes 20 and 22 being used together with holes 21 and 23 not being used; or holes 21 and 23 being used together with the others unused.

It is also particularly significant to note that the only physical connection between housing 10 and reflector assembly 12 is the two electrical wires 25 which electrically interconnect the lamp socket 17 and the electrical components within housing 10. It is also significant to note that the peripheral shape of the reflector 14, not considering the diagonal corners, is square.

Housing 10 includes four substantially identical side walls 28, 29, 30 and 31, and a back wall 32. The front edges of side wall 28–31 are equal in length, forming a square open front. A hinged front cover, not shown in FIG. 1, can be coupled to the front of the housing using fixed hinge openings 34, 35. A mounting knuckle indicated generally at 36 is provided in wall 29, the knuckle forming a mount and also a conduit for electrical conductors indicated generally at 37 which pass from the interior of housing 10 to an external electrical connection point such as a junction box. The knuckle itself does not form part of the present invention and will not be further described. It should also be mentioned that conventional electrical components such as a transformer 38 can be provided within the housing but, again, this is not part of the present invention and will not be described in detail.

The inner surface of wall 29 is provided with protruding bosses 40 and 41 and the inner surface of wall 31 is provided with similar bosses 43 and 44. All of these bosses have flat upper faces which lie in the same plane, that plane being parallel with but spaced inwardly from the plane containing the exposed edge 45 of walls 28–31. It will be observed that the face of boss 43 is provided with an internally threaded hole 46 and boss 41 is similarly provided with an internally threaded hole 47, but that bosses 40 and 44 do not have such holes. Holes 20 and 22 in reflector 14 are positioned such that, when the reflector is placed in the opening with the flange of the reflector lying on the faces of bosses 40, 41, 43 and 44, holes 20 and 22 are aligned with threaded holes 46 and 47, respectively, so that conventional machine screws or the like can be used to hold the reflector in place. With the openings aligned as just described, the longitudinal axis of lamp 15 is approximately aligned with walls 28 and 30 of the housing.

However, it is also possible to rotate reflector 14 90° so that holes 21 and 23 are respectively aligned with holes 46 and 47 and in that position the reflector is oriented such that the longitudinal axis of lamp 15 is approximately parallel with walls 29 and 31. Because of the fact that walls 28–31 taper inwardly toward back wall 32, the parallel relationship is not precise.

The fact that the periphery of reflector 14 is square and that the lamp and the concave portion 16 of the reflector have a particular relationship means that this change in orientation takes on considerable significance. Lamp 15 is a lamp of the type known as HPS S55 which is a high pressure sodium lamp having an arc chamber 50 which is elongated such that the source of light itself is not a point or spherical source but is much longer along the axis of the lamp than in other directions. Reflector 14 is formed so that the concave reflective portion 16 thereof projects reflected light in a particular pattern. Preferably, surface 16 is a parabolic surface of revolution except, of course, for a small portion at one end through which lamp socket 17 extends. If the light source in lamp 15 were a point source located at the focus, the light reflected by reflector 16 would be substantially uniform in all directions. However, the elongated source passes through the focal point and extends beyond it a significant distance. Because of this, the pattern is generally rectangular in shape and is significantly longer in one direction than in the other.

This phenomenon is illustrated in FIGS. 2–5. Referring first to FIGS. 2 and 3, it will be seen that the reflector is mounted in FIG. 2 so that the socket 17 is down, closest to knuckle 36, and the light source has a longitudinal axis which is approximately parallel with walls 28 and 30. In this orientation, the light from lamp 15 is reflected from concave surface 16 in such a way that the rays form a wide pattern, extending outwardly at significant angles, illustrated as being about 30° , but selectable depending upon the chosen curvature for portion 16. In this orientation, holes 20 and 22 are aligned with holes 46 and 47.

With the reflector in the same orientation, but viewing the luminaire from the top, it will be seen that the light source functions as a point source in a generally horizontal plane, and that the light from lamp 15 is projected such that the rays are substantially parallel with each other. Thus, if the luminaire is mounted such that walls 28 and 30 are substantially vertical, the light pattern is much taller than it is wide at any distance from the luminaire.

By simply rotating the reflector such that holes 21 and 23 are aligned with holes 46 and 47, base 17 is closest to wall 30, and the longitudinal axis of the light source is approximately parallel with walls 29 and 31. In this arrangement, with the luminaire mounted such that walls 28 and 30 are in vertical plane, the light pattern as viewed from the side (FIG. 4) shows that the light rays in horizontal planes are substantially parallel with each other, whereas, as viewed from the top, the light pattern is much wider than it is tall. This provides a degree of flexibility at the installation site which has not previously been conveniently possible.

FIG. 6 shows, for the sake of completeness, the structural details of the mounting for the reflector in housing 10. The orientation chosen is that closest to the position of FIG. 1 in which openings 20 and 22 are aligned with holes 46 and 47, a hexagonal head screw 54 being illustrated as the fastener to hold these together. Also shown in FIG. 6 is bracket 20 which is attached to the flange of reflector 14 by rivets 19 and which is attached to socket 17 by fasteners such as screws 55. Bracket 20 is simply an L-shaped sheet metal member. FIG. 6 further shows the structure for a cover having a frame 60, a pane of glass 62, and a gasket 64 of elastomeric material which rests on rim 45 of walls 28–31. Housing 10 is also provided with corner bosses 66, 67 which are provided with internally threaded openings so that screws 68 and 69 can be placed through the cover and into the holes to hold the cover in place. The other end of the cover is held by arcuate straps passing through hinge members 34, 35 as previously mentioned.

It should also be noted that, while the lamp is shown and described as being fixedly mounted with source 50 passing through the focus of reflective surface 16, it is possible to mount socket 17 and lamp 15 such that source 50 lies forward of the focus, a change which would cause the light distribution to be narrower in both directions. Mounting the lamp closer to the reflector would, conversely, cause the beam to be wider in both directions. With this in mind, it would be quite possible to provide elongated holes through bracket 20 so that screws 55 could be loosened to adjust the spacing of socket 17 and lamp 15 relative to reflector 16.

While one advantageous embodiment has been chosen to illustrate the invention, it will be understood by those skilled in the art that various changes and modifications can be made therein without departing from the scope of the invention as defined in the appended claims.

What is claimed is:

1. A luminaire comprising the combination of a housing having a generally parallelepipedic shape and a square open side;

a mounting device fixedly attached to an exterior surface of said housing;

a reflector having a curved, concave reflective surface and a square periphery dimensioned to be received in said open side in any of its four orientations;

a lamp socket mount attached to said reflector and extending rearwardly thereof:

a lamp having an elongated light source therein;

a lamp socket attached to said mount and extending through said reflector to hold said lamp in front of said concave surface; and fastener means for removably attaching the assembly comprising said reflector, mount, lamp and socket to said housing in any selected one of said orientations.

2. A luminaire according to claim 1 and further comprising a transparent cover hingedly coupled to said housing for protectively covering said open side with said reflector attached in said housing.

3. A luminaire according to claim 2 for use with a lamp having an elongated arc light source therein wherein said concave reflective surface is a parabolic surface of revolution shaped to form a relatively narrow substantially parallel beam in one plane and a wide beam in a plane perpendicular thereto.

4. A luminaire according to claim 3 and further comprising circuit means in said housing for energizing said lamp, said circuit means including conductors connected to said socket of sufficient length to permit removal and reorienting of said reflector without disconnection of any internal wiring connections.

5. A luminaire according to claim 4 wherein said housing includes inwardly extending members having internally threaded holes on opposite walls and said reflector includes holes on all four sides positioned so that two holes are aligned with said threaded holes in any of said four orientations.

6. A luminaire according to claim 3 wherein said housing includes inwardly extending members having internally threaded holes on opposite walls and said reflector includes holes on all four sides positioned so that two holes are aligned with said threaded holes in any of said four orientations.

7. A luminaire according to claim 2 wherein said housing includes inwardly extending members having internally threaded holes on opposite walls and said reflector includes holes on all four sides positioned so that two holes are aligned with said threaded holes in any of said four orientations.

8. A luminaire according to claim 2 and further comprising circuit means in said housing for energizing said lamp, said circuit means including conductors connected to said socket of sufficient length to permit removal and reorienting of said reflector without disconnection of any internal wiring connections.

9. A luminaire according to claim 1 wherein said housing includes inwardly extending members having internally threaded holes on opposite walls and said reflector includes holes on all four sides positioned so that two holes are aligned with said threaded holes in any of said four orientations.

10. A luminaire according to claim 1 and further comprising circuit means in said housing for energizing said lamp, said circuit means including conductors connected to said socket of sufficient length to permit removal and reorienting of said reflector without disconnection of any internal wiring connections.

11. A luminaire according to claim 1 for use with a lamp having an elongated arc light source therein wherein said concave reflective surface is a parabolic surface of revolution shaped to form a relatively narrow substantially parallel beam in one plane and a wide beam in a plane perpendicular thereto.

* * * * *